US006179244B1

(12) United States Patent
Rodriguez

(10) Patent No.: US 6,179,244 B1
(45) **Date of Patent: *Jan. 30, 2001**

(54) PAPER CUTTING TAPE PACKAGE

(76) Inventor: Peter A. Rodriguez, 13612 McQueens Ct., Jacksonville, FL (US) 32225

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/092,185

(22) Filed: Jun. 5, 1998

(51) Int. Cl.[7] ..... B65H 16/02; B65D 85/66

(52) U.S. Cl. ..... 242/588.6; 242/594.4; 206/391; 206/408; 206/409

(58) Field of Search ..... 242/588.3, 588.6, 242/594, 594.3, 594.4, 594.5, 594.6; 206/391, 394, 395, 397, 408, 409

(56) References Cited

U.S. PATENT DOCUMENTS

| | | | | |
|---|---|---|---|---|
| 456,630 | * | 7/1891 | Morse . | |
| 556,068 | * | 3/1896 | Schloss | 242/594.3 |
| 1,268,222 | * | 6/1918 | Dwyer | 242/594.3 X |
| 1,295,372 | * | 2/1919 | Riddle et al. | 242/594.3 X |
| 2,449,508 | * | 9/1948 | Reynolds | 242/594.3 X |
| 2,526,440 | * | 10/1950 | Toombs | 242/594.3 |
| 2,929,496 | * | 3/1960 | Muehlebach et al. . | |
| 3,166,187 | * | 1/1965 | Araujo | 242/588.6 |
| 3,442,394 | * | 5/1969 | McCune et al. . | |
| 3,877,575 | * | 4/1975 | Cracco et al. | 206/391 |
| 4,735,342 | * | 4/1988 | Goldstein | 242/594.3 X |
| 5,415,289 | * | 5/1995 | Kim | 206/394 |
| 5,507,386 | * | 4/1996 | Foote | 206/394 |
| 5,570,856 | * | 11/1996 | Sharpe | 242/588.3 |
| 5,704,479 | * | 1/1998 | Barnett et al. | 242/588.6 X |
| 5,718,365 | * | 2/1998 | Palmer | 242/594.3 X |

FOREIGN PATENT DOCUMENTS

| | | | | |
|---|---|---|---|---|
| 584780 | | 10/1959 | (CA) | 206/408 |
| 12078 | * | 5/1896 | (CH) | 206/391 |
| 993282 | * | 10/1951 | (FR) | 206/395 |
| 2401850 | * | 4/1979 | (FR) | 206/409 |
| 2679533 | * | 1/1993 | (FR) | 206/394 |
| 2682361 | * | 4/1993 | (FR) | 206/397 |
| 8353 | * | of 1894 | (GB) | 206/391 |
| 2031834 | * | 4/1980 | (GB) | 206/394 |
| 2130999 | * | 6/1984 | (GB) | 242/588.6 |

* cited by examiner

*Primary Examiner*—Donald P. Walsh
*Assistant Examiner*—William A. Rivera

(57) ABSTRACT

A package of cutting tape for use in cutting a swiftly moving web of paper being spooled into a roll, and transferring the cut web to a new roll. The package includes a plurality of thin discs of wound cutting tape with each disc having one width of tape wrapped upon itself to form a large diameter disc of tape. The discs are separated from each other by spacers. The package is enclosed by a container having an opening to permit unrolling of the tape without imparting any twist thereto.

25 Claims, 6 Drawing Sheets

PAPER CUTTING TAPE PACKAGE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

This invention relates to a method for cutting and spooling a travelling web of paper; and more particularly, it relates to the packaging of a cutting tape which is used to cut the web of paper when a roll has been filled and is transferring the travelling web to an empty spool.

2. Description of Related Art

It is a general practice in the paper industry to produce a continuous sheet or web of paper which is wound onto large spools. The web is cut when one spool is full and the web is then wound onto an empty spool. Because the process is continuous, the cutting process needs to be quick and reliable.

The cutting of the web is usually accomplished by the use of a cutting paperband or tape made up of several strands of repulpable paper. The strands are laid together side-by-side in a lengthwise parallel abutting relationship and adhered to each other by a water soluble adhesive to create a tape 1 strand thick and perhaps 10–20 strands wide. One method of creating a cutting tape is shown in U.S. Pat. No. 3,126,312. Applicant discloses one use of a tape cutting device and method in U.S. Pat. No. 4,659,029.

The cutting tape supplied to the industry is wound on a spool in a spiral approximately 6" wide×16" diameter. The principal problem with this method of winding is that the paperband will retain a curvature introduced by the spiral winding over the core. After winding the tape will have right and left-hand curvature. This curvature can cause twisting of the tape and the doubling over itself in the nip during turnup. The tape closest to the core will have the greatest curvature. The curvature of the tape also makes it difficult to feed the tape through the guideways often used for the cutting and turn up operation. It is therefore desirable that the curvature be eliminated and to do so in a way that further improves the cutting operation.

BRIEF DESCRIPTION OF THE SEVERAL VIEWS OF THE DRAWING

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
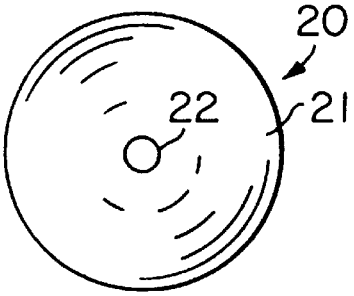
FIG. 1 is a side elevation of one roll of cutting tape to be used in the dispenser according the to the present invention.
Figure 2:
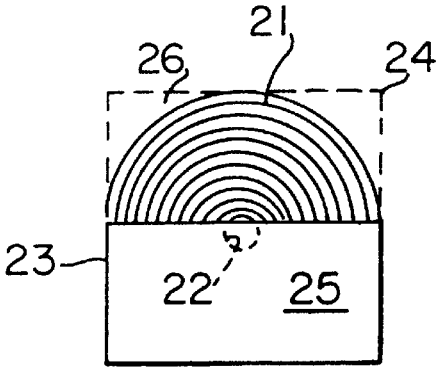
FIG. 2 is a side elevation of the tape of FIG. 1 as contained in a retaining folder of the dispenser according to the present invention.
Figure 3:
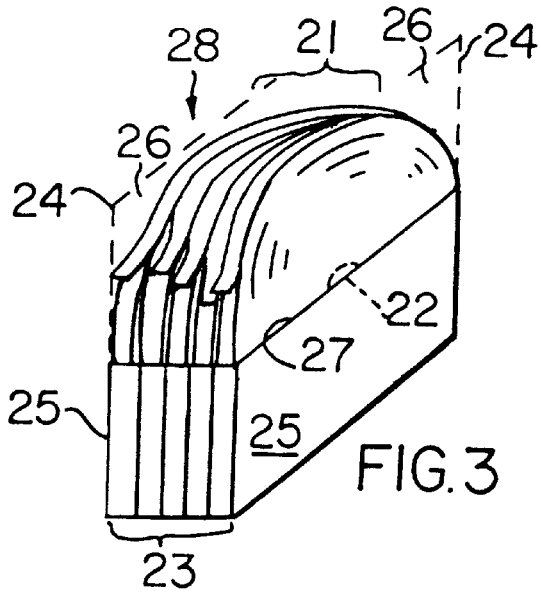
FIG. 3 is a perspective of several retaining folders grouped together according to the present invention carrying several rolls of tape.

With reference now to the drawings, a single roll of cutting tape is depicted at numeral 20 in FIG. 1. The tape 21 is wound around a hollow fiber core 22 and attached thereto by conventional adhesive (not shown). The tape 21 is generally less than 1.0 inch wide. The roll 20 will generally have a diameter of 20–24 inches. In FIG. 2 a retaining folder 23 is formed as a tray which has a near wall 25 that extends to slightly above the axis of the core 22. A cardboard box 24 will contain several rolls 21 each in a separate folder (FIG. 3). The box 24 has walls 26 shown in outline that extend above the diameter of a roll 21, thus providing protection of the rolls 21 during handling as well as in usage for dispensing the band in paper cutting.

The arrangement of tape rolls 21 shown in FIGS. 1–3 has several advantages. First, the tape 21 is wound as a ribbon thus eliminating the curvatures found in spiral-wound arrangements. Second, the folder 23 contains a given tape roll 21 in a manner to keep it from becoming loose or falling apart. Walls 23 extend above the axis of the core 22. Third, it is possible to eliminate core 22 entirely or to greatly reduce its diameter to increase the amount of paperband in a roll 20. It is not possible to eliminate the core in prior art rolls due to the very nature of the spiral winding. Fourth, less torque is required to unwind the tape 21 from a given roll 20. There is less internal drag or friction in the carrying of the roll 20 in folder 23. This feature is important because the present invention contemplates automatic machine control of the tape 21 handling and loading. The less friction in movement the faster and more reliable the control of the tape 21. Fifth, the use of the folders 23 in box 24 reduces the handling of the tape by the end user thus reducing the possibility of mishandling and contamination of the tape 21 and the like. The arrangement illustrated in FIGS. 1–3 constitutes a dispenser 28. Any number of roll/folder combinations can be used in a single dispenser 28. Preferably, the actual number of rolls per box 24 will be between 7 and 10.

Figure 4:
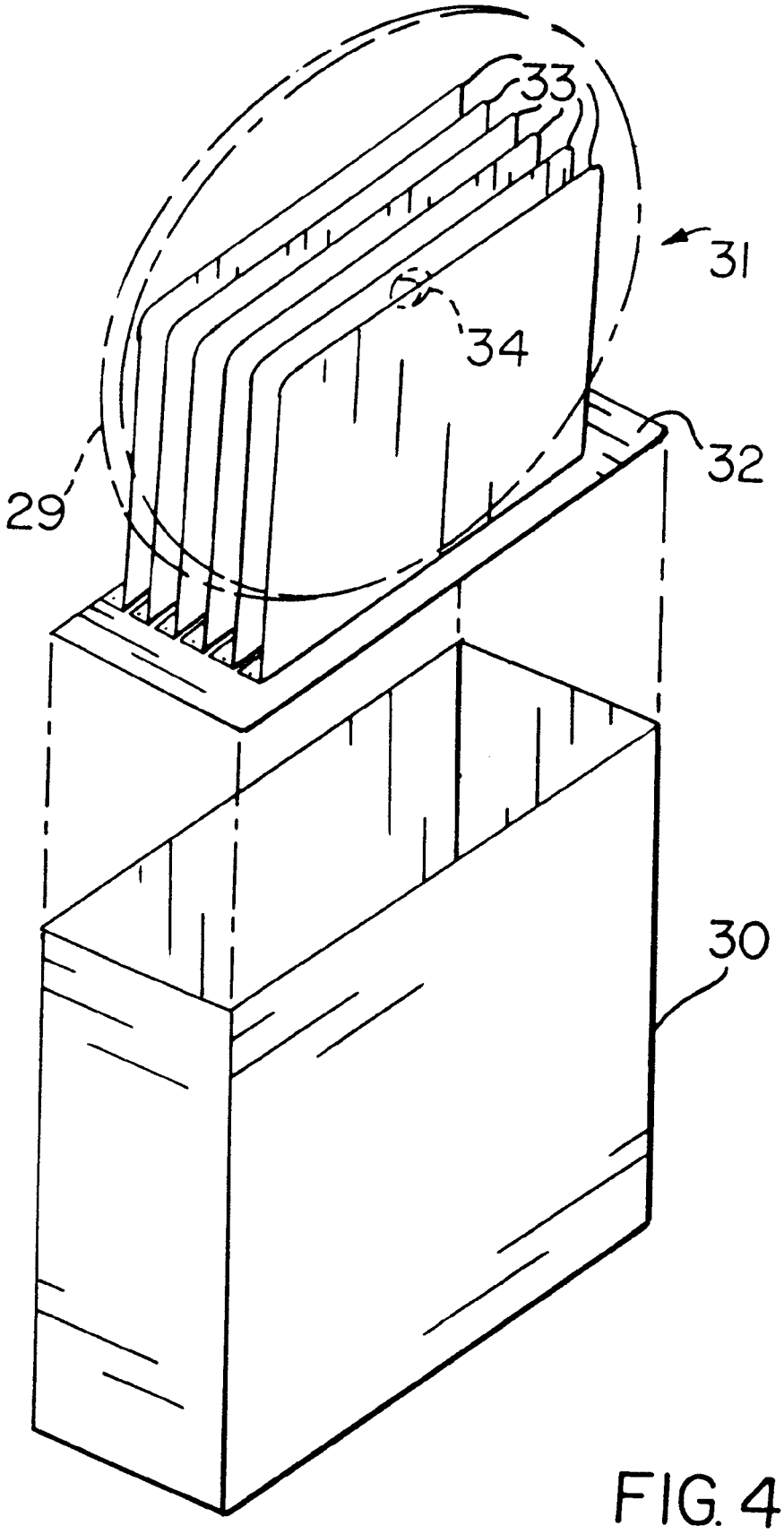
FIG. 4 is a pictorial view of the retaining folder of FIG. 3 shown in relationship to a carrier carton of the dispenser in accord with the present invention.
Figure 10:
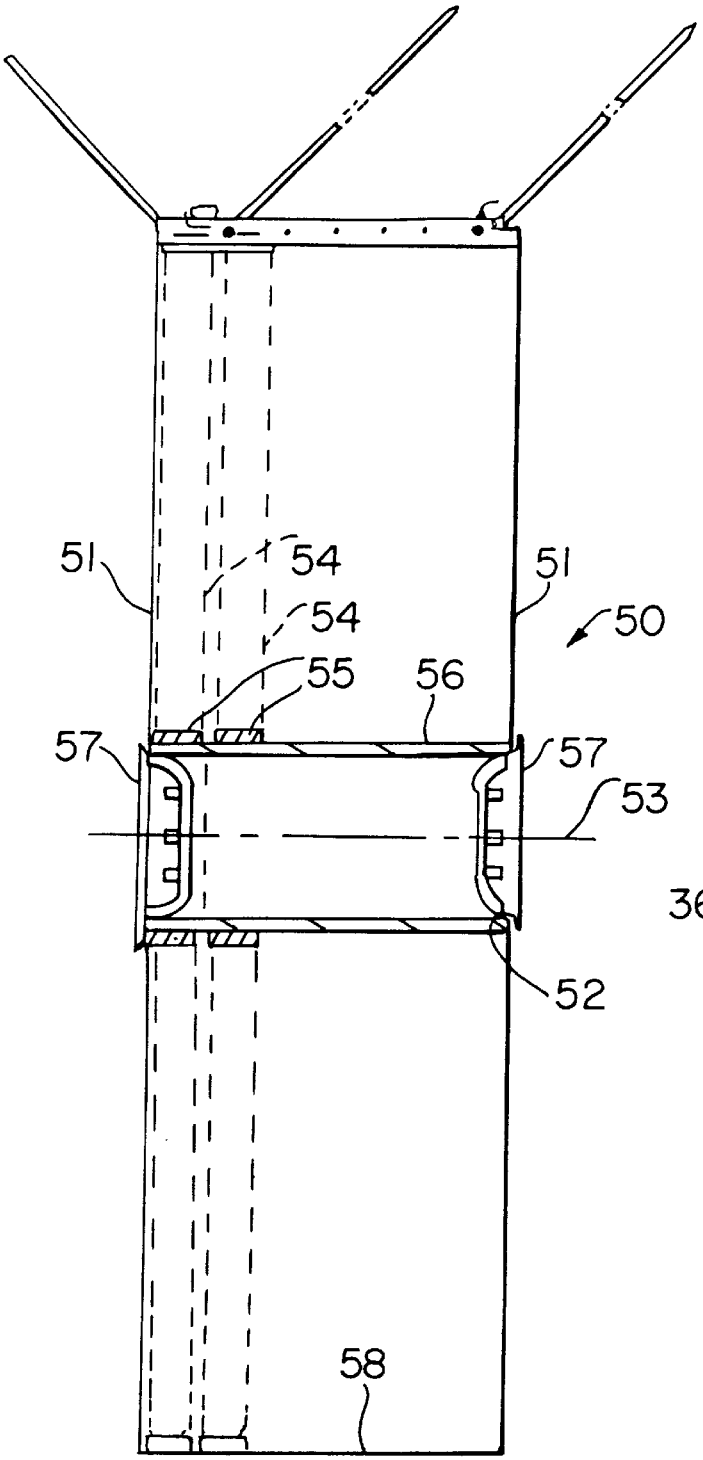
FIG. 10. is a top diagrammatic view of the arrangement of two of a plurality of tape rolls on a common axis in one embodiment of the present invention.

FIG. 4 illustrates another embodiment of the cutting tape dispenser according to the present invention. A plurality of tape rolls 29, otherwise identical to rolls 20, are placed in a cardboard or metal box or tray 30. A removable metal divider 31 (FIGS. 4 and 5) having base 32 and a plurality of divider vanes 33 hold each roll 29 separately. Divider 31 is placed in box 30. Roll 34 may be filled with a fiber core (not shown) for each roll 29 if desired. The height of a vane 33 should be greater than the radius of a roll 29 to provide lateral support a roll 29.

Figure 6A:
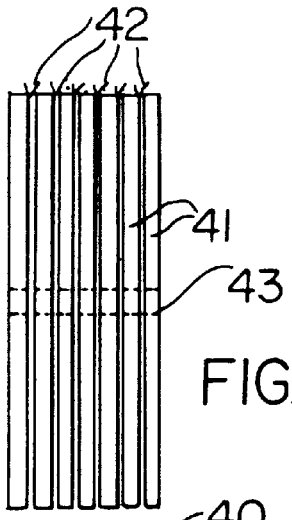
FIG. 6A is a front elevation view of a plurality of individual tape spools separated by paper dividers.
Figure 6B:
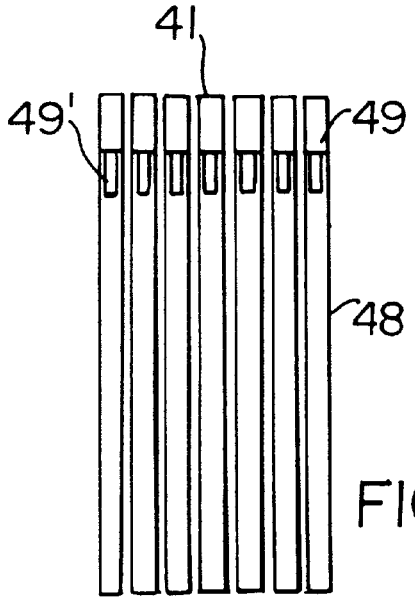
FIG. 6B is a front elevation of a plurality of individual boxes holding the tape spools of FIG. 6A.
Figure 7:
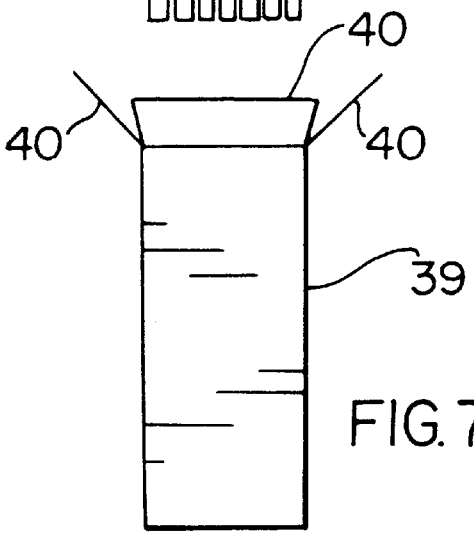
FIG. 7 is a front elevation view of a cardboard shipping box used in the present invention.
Figure 9:
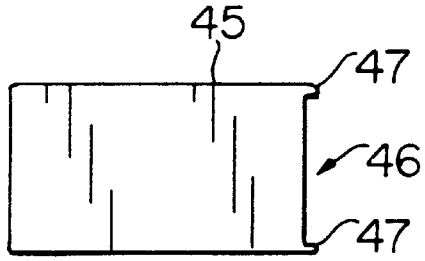
FIG. 9 is a top view of a lid used with the box of FIG. 8.
Figure 8:
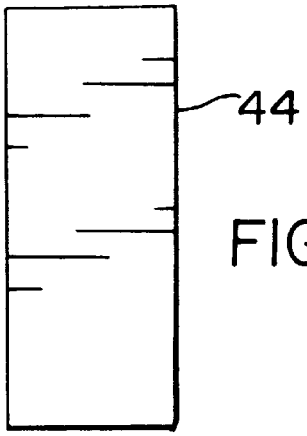
FIG. 8 is a front elevation of an optional stainless steel box used in the present invention.
Figure 5A:
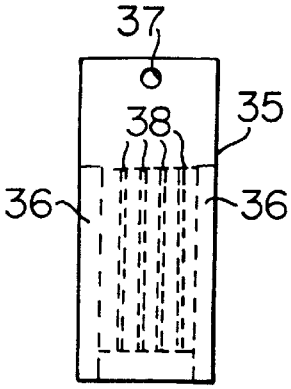
FIG. 5A is a front elevation view of a removable metal divider used in one embodiment of the dispenser in accord with the present invention.
Figure 5B:
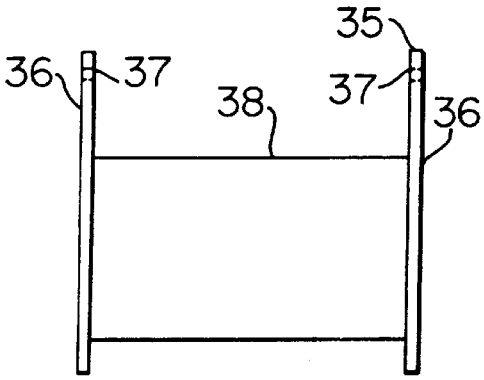
FIG. 5B is a side elevation view of the divider of FIG. 5A.

FIGS. 5A and 5B illustrate another embodiment of a retaining folder/separator 35. Two end walls 36 with finger holes 37 are used to mount a plurality of spaced separator vanes 38. Separator 35 fits into a box 39 (FIG. 7) having lid flaps 40. For ease of tape withdrawal one end flap 40 may be removed. FIG. 6 A illustrates a variation on the separator 35 wherein a plurality of tape rolls 41 are separated by paper dividers 42. Each roll has center hole 43 which may be empty or include a fiber core. If separator 35 is used with rolls 41 the paper separators 42 are not used. The box 39 is then inserted into metal container 44 for shipping. Container 44 is best used also as a tape dispenser at its destination. Container lid 45 is shown in FIG. 9 and terminates short of the top opening of container 44 to define via fingers 47 space 46 wherefrom the tape can be pulled from a roll 41.

The tape rolls 41 may each be inserted into an individual box 48 (FIG. 6B) that is quite narrow and resembles a "pizza box" with one box 48 for each roll of tape 41. Dividers would not be needed. Each box 48 has an outlet slot 49. The tape 41 can be partially withdrawn through the outlet slot 49 and secured to the outside of the box 48 at location 49' for ease of handling. The principal objectives to be met are the protection of the tape rolls, such as 41, and the preventing of the unwinding of an adjacent roll when one roll is being unwound. Accordingly, container 44 and lid 45 are optional depending upon the circumstances. Box 44 may also be undercut along one upper lid to cooperate with space 46 if so desired.

FIGS. 10–13 illustrate another embodiment of the tape dispensing means in accord with the present invention. Cardboard box 50 has two planar sides 51 in which are cut two holes 52 having an axis shown at dotted line 53. Each tape roll 54 utilizes a fiber core 55 into which fits an elongate second fiber core 56 fitted with end caps 57 that are secured to box 50 to keep the core 56 positioned centrally in the box 50 and to provide clearance for the edge of a full tape roll 54 and the bottom floor 58 of box 50 for low friction tape withdrawal.

Figure 11:
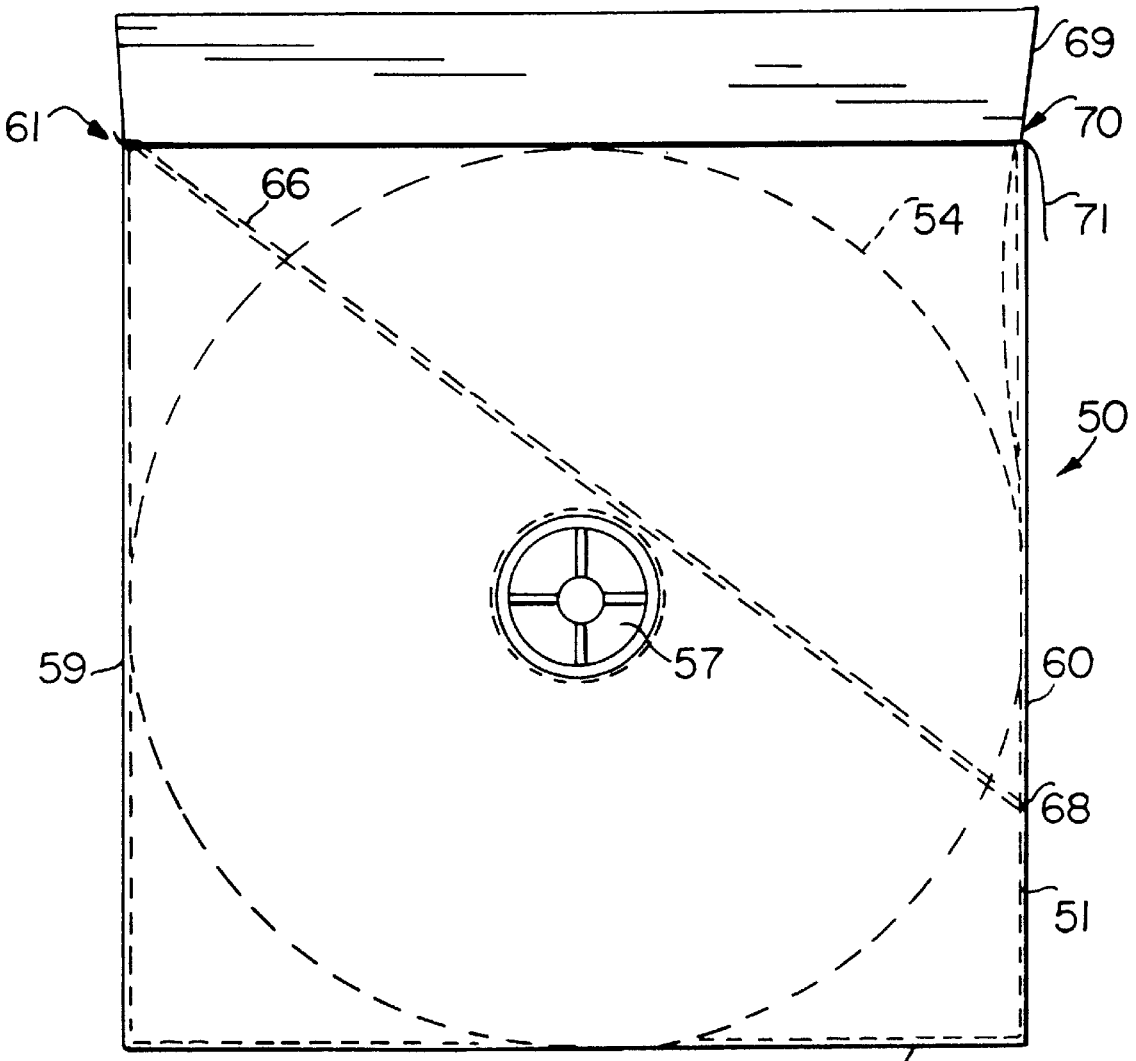
FIG. 11 is a side elevation diagram of another embodiment of the dispenser according to the present invention.
Figure 12:
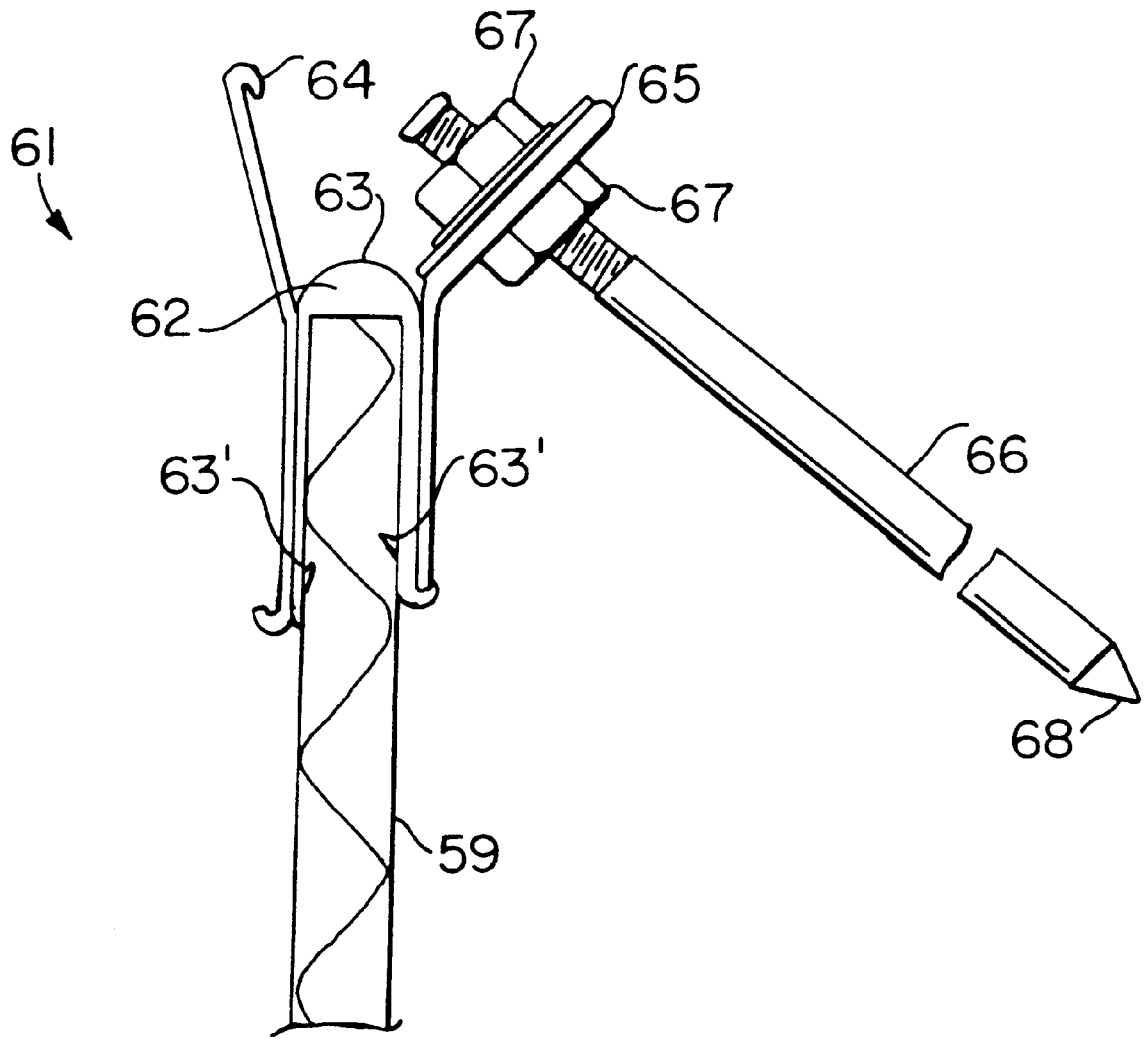
FIG. 12 is an enlarged pictorial diagram of a separator rod of FIG. 11.

FIG. 12 illustrates in enlarged detail the separator means used. A U-shaped elongated metal clamp assembly 61 is mounted along the upper edge 62 of box rear wall 59. The assembly includes a U-shaped spring element 63 having punched out prongs 63' impaled into wall 59 that can be removed from wall 59 by squeezing together arm member 64 and bracket member 65. Bracket member 65 carries a plurality of stiff metal rods 66 threaded into nuts 67 and having a sharp pointed end 68. As shown in FIG. 11, rods 66 are angled downwardly but spring-loaded upwardly to pass over the core 56 and drive point 68 against front wall 60. Each rod 66 functions as a separator which can be raised or lowered via assembly 61. The top 69 of box 50 may employ a dispensing space 70 similar to the space defined at 46 in FIG. 9 to provide for unwinding of a strip of tape 71. The tape 71 may be secured to the front wall 60 via adhesive (not shown) for shipping if so desired.

Figure 13:
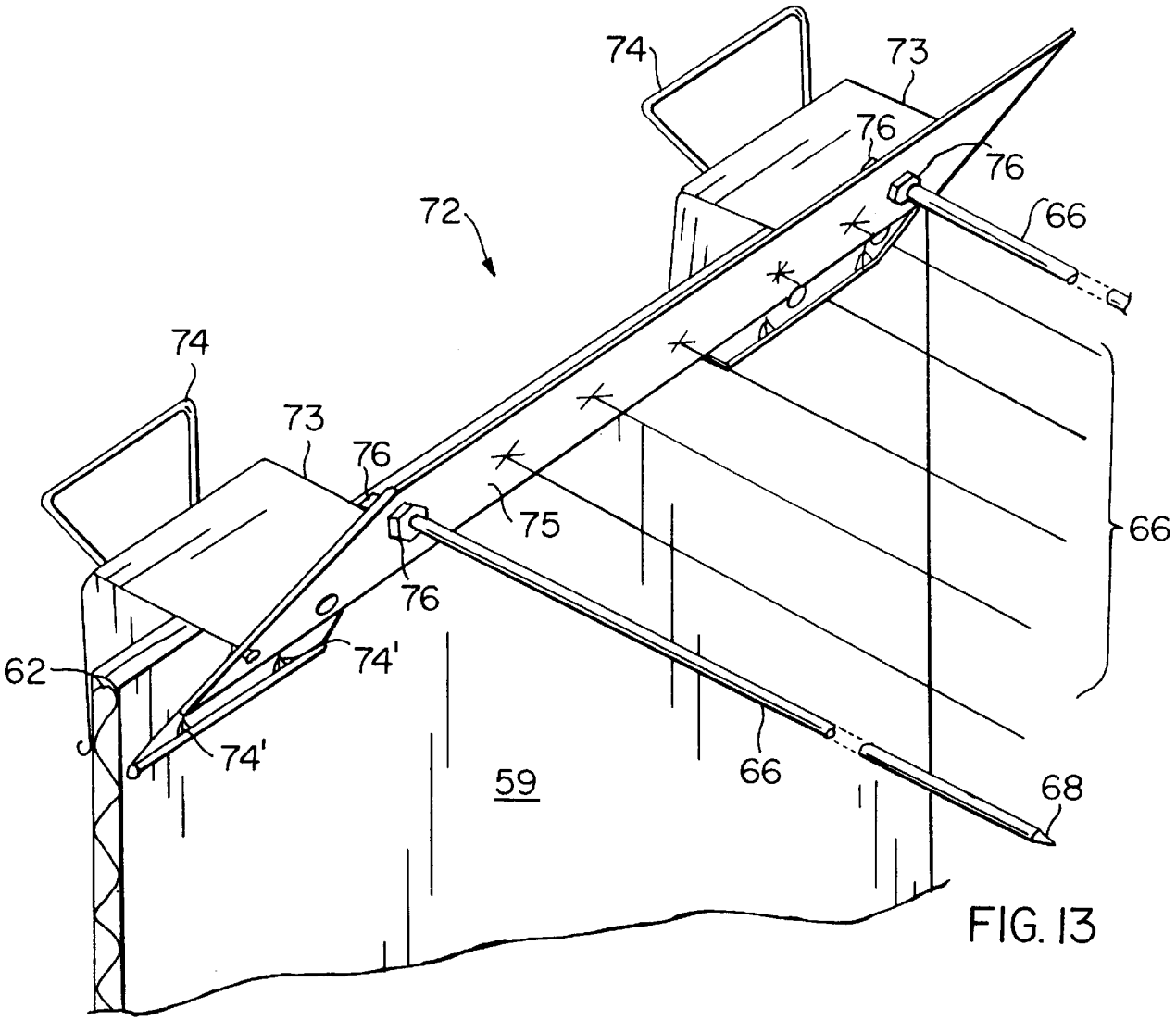
FIG. 13 is a perspective pictorial diagram of the separator and container of FIG. 11.

FIG. 13 illustrates an alternative clamp assembly 72 employing a pair of spring metal brackets 73. Spring members 74 having punched out prongs 74' impaled in rear wall 59 are used to squeeze the clamp 72 to secure it to top edge 62 of box 50. The elongate bracket plate 75 carries a plurality of spaced rods such as 66 which are threaded into nuts 76. It is to be understood that the precise shape and construction of clamp elements such as 63 and 73 can vary widely. What is important is the support and angling of the rods 66 to provide separation and the spring biased upward action to secure the rods 66 against front wall 60. A lid of appropriate construction may be used with the box 50 if desired in the circumstances.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A package of paper-cutting tape for cutting a traveling web of paper comprising a plurality of substantially closed square fiberboard cartons each containing one roll of paper-cutting tape formed as a thin disc wherein said disc is formed by wrapping said tape upon itself about an axis perpendicular to the wrapping direction of said tape, each said roll being carried within respective said carton having an exit passageway adjacent one corner of said carton through which said tape from said roll may be dispensed in a direction perpendicular to said axis, said disc having a width along said axis substantially equal to the width of said tape, the width of said carton closely conforming to said width of said disc, each said roll having a hollow central portion, and a container for enclosing said plurality of cartons, said container having a second exit passageway adjacent said exit passageways through which said tape from each said carton may be dispensed in a direction perpendicular to said axis.

2. The package of claim 1 wherein said container is formed of durable moisture-impervious material.

3. The package of claim 2 wherein said container includes a tray and a removable lid.

4. The package of claim 3 wherein said second exit passageway is located adjacent an upper corner of said container.

5. The package of claim 1 wherein said second exit passageway is located adjacent an upper corner of said container.

6. The package of claim 1 wherein said container includes a lid, said second exit passageway being located adjacent a corner in said lid.

7. A package for dispensing paper-cutting tape comprising a plurality of rolls of paper-cutting tape, each said roll being formed by trapping said tape upon itself about an axis perpendicular to the direction of wrapping, a plurality of substantially square thin boxes, each having a pair of spaced upper corners, each said roll being positioned in a respective said box, said boxes being arranged side-by-side to position said rolls in parallel with each other, each said box having an exit passageway adjacent at least one said corner of said box through which said tape from said roll therewithin may be dispensed in a manner perpendicular to said axis, a container for said boxes for maintaining said boxes in said side-by-side arrangement, and wherein each said roll has a hollow central portion, said container having another exit passageway through which said tape from each said box may be dispensed in a direction perpendicular to said axis.

8. The package of claim 7 wherein said container is made of fiberboard for shipping said boxes in said side-by-side arrangement further comprising a metal container for housing said container and said boxes in said container to protect said container and said boxes in use thereof in a paper making environment.

9. A package of paper tape comprising a plurality of rolls of paper tape, each said roll formed by wrapping said tape upon itself about an axis perpendicular to the direction of wrapping, each said roll being shaped in the form of a narrow circular disc, a covered container for carrying said rolls positioned side-by-side to position said rolls parallel to each other, spacer means for providing a space between each said roll and an adjacent said roll for inhibiting movement of adjacent said rolls when one said roll is rotated and to maintain said rolls parallel, said spacer means being sized to fit within said container, said spacer means including a plurality of elongated spaced rods having opposite end portions, each said rod being disposed respectively between adjacent said rolls, a support assembly for supporting at least one said end portion of said rod, said support assembly including clamp means for removably attaching said support assembly to an upper edge portion of said container.

10. The package of claim 9 wherein another end portion of each said rod is placed against a wall of said container oppositely disposed to said upper edge portion.

11. The package of claim 9 wherein said container is formed of durable moisture impervious material.

12. The package of claim 9 wherein said container includes a tray and a removable lid.

13. The package of claim 9 further including an exit passageway located adjacent an upper corner of said container for removal of said tape from said container.

14. The package of claim 9 wherein each said roll has a hollow central portion for rotatably mounting said roll inside said respective box.

15. A package of paper-cutting tape comprising a plurality of rolls of paper-cutting tape, each said roll formed by wrapping said tape upon itself about an axis perpendicular to the direction of wrapping, each said roll being shaped in the form of a narrow circular disc, a covered container for carrying said rolls positioned side-by-side to position said rolls parallel to each other, spacer means for providing a space between each said roll and an adjacent said roll to allow any one of said rolls to be rotated for removal of tape from said any one of said rolls and then from another of said rolls, said spacer means inhibiting movement of said adjacent rolls when said any one of rolls is rotated and to maintain all said rolls parallel, said spacer means including a single divider sized to fit within said container, said divider including a planar base member and a plurality of spaced divider vanes each having a lower portion secured to said base member and an upper portion extending upwardly from said base member.

16. The package of claim 15 wherein said container includes a tray and a removable lid.

17. The package of claim 16 wherein said container includes an exit passageway located adjacent an upper corner of said container for removal of said tape from said container.

18. The package of claim 16 wherein said tray is formed of metal.

19. The package of claim 16 wherein said lid is formed of metal.

20. The package of claim 15 wherein said container includes an exit passageway located adjacent an upper corner of said container for removal of said tape from said container.

21. The package of claim 15 wherein said container is formed of durable moisture impervious material.

22. The package of claim 15 wherein said container includes a lid and an exit passageway located adjacent an upper corner of said container for removal of said tape from said container, said exit passageway being located adjacent a corner in said lid.

23. The package of claim 15 wherein said container is formed of metal.

24. The package of claim 15 wherein said upper portion of each vane is sized to extend upwardly a distance greater than the radius of a said roll to provide lateral support for said roll.

25. The package of claim 15 wherein said divider is formed of metal.

* * * * *